United States Patent [19]

Janssens et al.

[11] 4,391,047

[45] Jul. 5, 1983

[54] HAND-HELD HAIR DRYER

[75] Inventors: Wilhelmus G. E. Janssens, Drachten, Netherlands; Heinz Merges, Cologne, Fed. Rep. of Germany

[73] Assignee: U.S. Philips Corporation, New York, N.Y.

[21] Appl. No.: 130,945

[22] Filed: Mar. 17, 1980

[30] Foreign Application Priority Data

Mar. 20, 1979 [NL] Netherlands ..... 7902158

[51] Int. Cl.[3] ..... F26B 19/00

[52] U.S. Cl. ..... 34/97; 34/243 R; 219/373; 239/559; 239/602

[58] Field of Search ..... 34/97, 99, 243 R; 239/602, 600, 559, 452; 219/373

[56] References Cited

U.S. PATENT DOCUMENTS

| | | | |
|---|---|---|---|
| 1,422,291 | 7/1922 | Mucherin | 239/559 |
| 1,555,393 | 9/1925 | Von Hermann | 239/559 |
| 3,073,037 | 1/1963 | Fay | 34/99 |
| 3,533,169 | 10/1970 | Swetlitz et al. | 34/99 |
| 4,230,279 | 10/1980 | Forsberg | 34/97 |

*Primary Examiner*—Larry I. Schwartz

*Attorney, Agent, or Firm*—Thomas A. Briody; William J. Streeter; Rolf E. Schneider

[57] ABSTRACT

An attachment formed of a flexible material is provided for use with a hair dryer having an air discharge nozzle, the attachment being expandable in use from a collapsed position to an expanded shape. It comprises an imperforate funnel-shaped wall portion open at both ends, the small end being connectable to the air discharge nozzle. An outer end wall provided with outlet openings extends across the larger end of the funnel-shaped wall portion and is connectable thereto. Flexible strips situated within the funnel-shaped wall portion connect the central portion of the outer end wall to the small end of the funnel-shaped wall portion and serve to maintain the outer end wall in its expanded shape during use.

5 Claims, 5 Drawing Figures

HAND-HELD HAIR DRYER

This invention relates to a hand-held hair dryer having a housing provided with a handle and a nozzle for the outflowing air.

It is the object of the invention to make such an apparatus more versatile and, in particular, to spread the emerging concentrated stream of air over a larger area.

The construction in accordance with the invention is characterized in that the apparatus is equipped with an attachment of a substantially flexible material having an imperforate funnel-shaped wall portion, the small end of which is connectable to the nozzle and the larger end of which adjoins an outer end wall which is also made of a flexible material and is formed with a plurality of outlet openings.

Such an attachment moreover has the advantage that it can be collapsed or folded into a package of very small volume.

A preferred embodiment is characterized in that the outer end wall with outlet openings is connected to the small end by means of one or more strips of a flexible material, which are situated within the funnel-shaped wall portion.

An embodiment which enables the attachment to be fitted and removed in a simple and rapid manner is characterized in that such small end includes an elastic band for an air-tight connection to the nozzle.

A different embodiment is characterized in that such small end is connectable to a tubular section which can be slid onto the nozzle and in which the flexible attachment can be collapsed or folded.

A related special embodiment is characterized in that the outer end wall with outlet openings is provided with a non-flexible disc-shaped central portion, which also constitutes a cover which fits onto the tubular section.

Another special embodiment is characterized in that the tubular section is formed at its inner end with a grill which allows the passage of air.

The invention is also embodied in an attachment as used in one of the hand-held dryers described above.

The invention will now be described in detail in connection with the accompanying drawings, in which FIG. 1 shows a hand-held hair dryer with an attachment in perspective view.

FIG. 2 is a cross-section of the nozzle and the attachment of the hand-held hair dryer of FIG. 1.

FIG. 3 in perspective shows a hand-held hair dryer with a different embodiment of the attachment.

Figure 1:
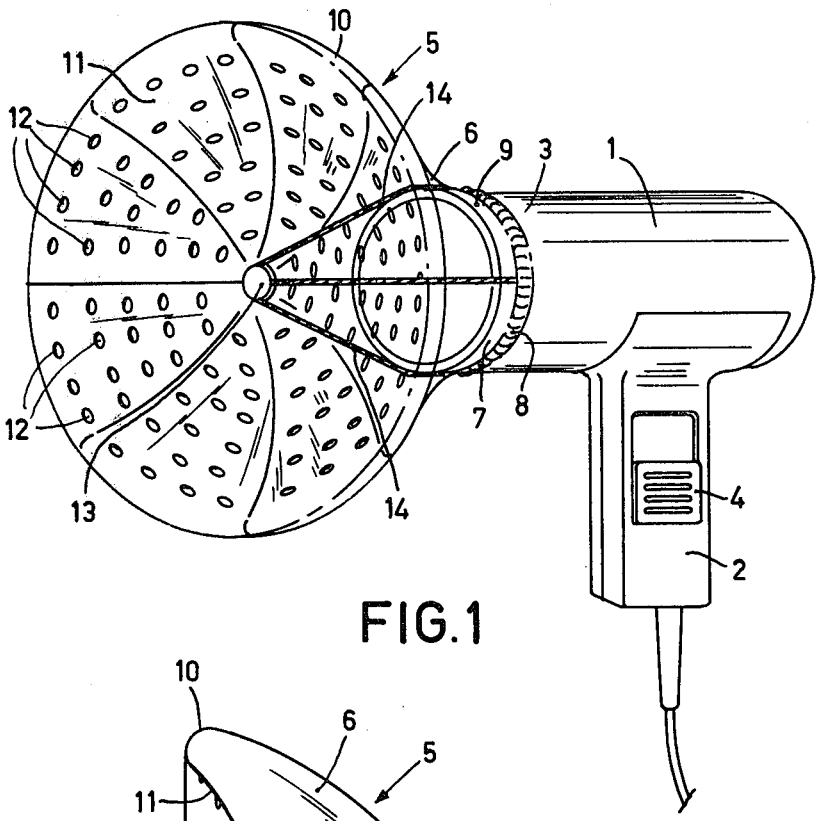

The hand-held hair dryer of FIG. 1 comprises a housing 1 with a handle 2 and a nozzle 3. The housing accommodates known elements, not shown, such as an electric motor, which is coupled to a fan, and a heating element. The electrical lead to these elements includes a switch, which can be actuated by means of a slide button 4 on the handle 2.

On the nozzle 3 an attachment 5 is fitted of a flexible material, for example a thin transparent plastic foil. The attachment includes an imperforate funnel-shaped wall portion 6 open at both ends, (also see FIG. 2), whose small end 7 adjoins the nozzle 3. Such small end 7 is provided with an elastic band 8, for example of rubber, which is situated behind a rim 9 of the nozzle and which is tightened around the nozzle. This provides an air-tight connection of the attachment to the nozzle.

The larger end 10 of the funnel-shaped wall portion 6 adjoins and is connected to an outer end wall 11, which extends across such larger end 10 and is also made of a flexible material and which is formed with outlet openings 12. The central portion 13 of the outer end wall 11 is connected to the small end 7 by four flexible strips 14 situated within the funnel-shaped wall portion.

Figure 2:
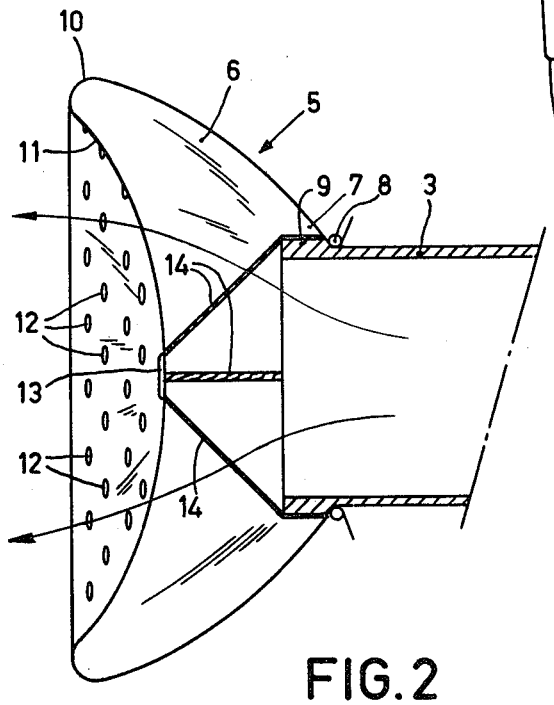

The air which is expelled from the nozzle 3 of the hand-held dryer blows up the attachment 5 from its collapsed position to the expanded shape shown in the FIGS. 1 and 2. The strips 14 then keep the outer end wall 11 in the position shown. The stream of air flows out through the outlet openings 12 to the hair to be treated. By the use of this attachment the air stream is divided over a larger area, so that the hair is dried more uniformly and the likelihood of the hair dress being disturbed by the air stream is reduced. By making the total area of the outlet openings 12 greater than that of the nozzle 3 the flow rate of the air can be reduced, so that the likelihood of the hair dress being disturbed is also reduced.

Since the attachment is made of a flexible material contact with the hair dress is harmless. A substantial advantage is that the attachment may be collapsed or folded into a very small package.

Figure 3:
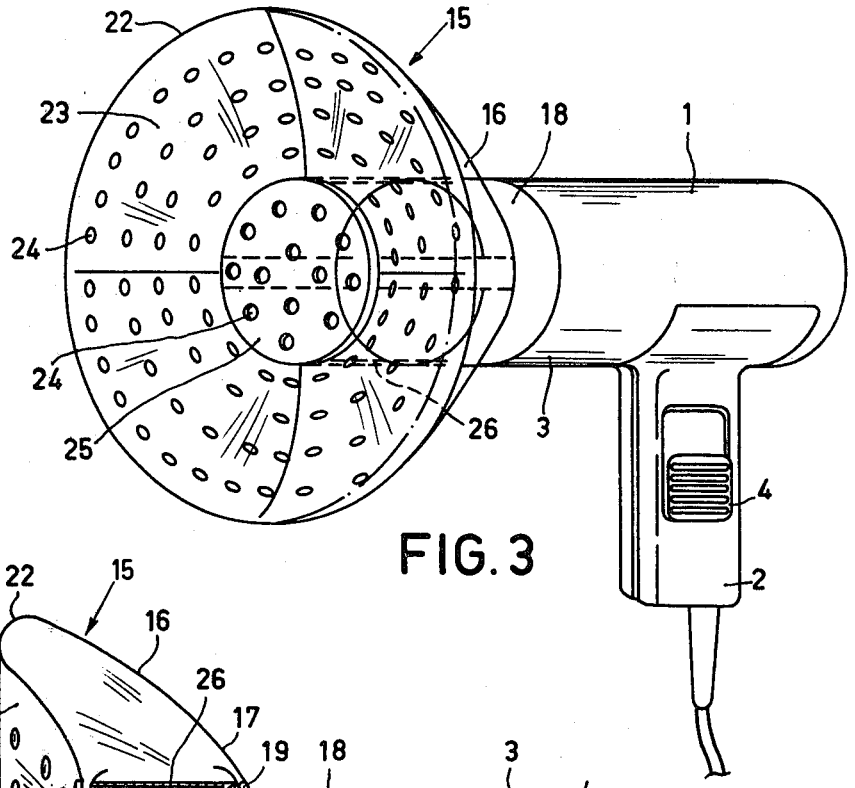
Figure 4:
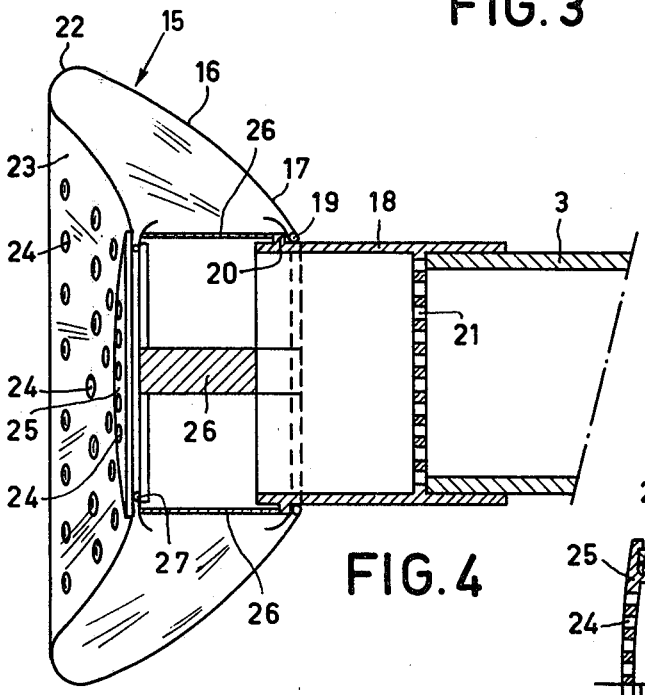
FIG. 4 is a cross-section of the nozzle and the attachment of the hand-held hair dryer of FIG. 3.

The attachment 15 of the embodiment shown in FIGS. 3 through 5 is shown again in FIG. 3 in the position in which attachment 5 is mounted on a hand-held hair dryer as described with reference to FIG. 1.

The attachment 15 also includes an imperforate funnel-shaped wall portion 16 (FIG. 4) but at its small end 17 it is connected to a pipe or tubular section 18. For this purpose such small end 17 is for example also provided with an elastic band 19 which is situated behind a rim 20 on the pipe section 18. The pipe section 18 is slid onto the nozzle 3 of the hand-held hair dryer and includes a grill 21 which allows the passage of air.

The larger end 22 of the funnel-shaped wall portion 16 adjoins and is connected to an outer end wall 23 provided with outlet openings 24. This outer end wall has a disc-shaped non-flexible central portion 25 which is also formed with outlet openings 24. The disc-shaped central portion 25 is connected to the elastic band 19 by means of four flexible strips 26.

By means of an elastic band 27 the outer end wall 23 is attached to the disc-shaped central portion 25.

The function and the operation of the attachment 15 are identical to those of attachment 5 in accordance with FIGS. 1 and 2.

Figure 5:
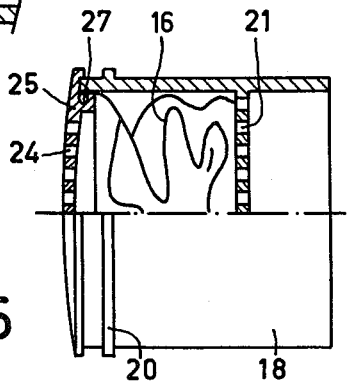
FIG. 5 shows the attachment of the embodiment in accordance with FIGS. 3 and 4 in the folded condition.

When the attachment 15 is not in use the elastic band 19 may be removed from the pipe section 18 and the parts of a flexible material, i.e. the imperforate funnel-shaped wall portion 26, the outer end wall 23 and the flexible strips 26, may be folded into the pipe section 18 (FIG. 5). The disc-shaped central portion 25 then closes said pipe as a cover, whilst the grill 21 functions as a bottom. In this way the attachment 15 may be stored in a very compact manner, whilst the parts of a flexible material are protected against damage.

What is claimed is:

1. An attachment formed of a substantially flexible material for use with a hair dryer having an air discharge nozzle, said attachment being expandable in use from a collapsed position to an expanded shape, which comprises an imperforate funnel-shaped wall portion open at both ends; means to connect the small end of said funnel-shaped wall portion to the air discharge nozzle; an outer end wall extending across the larger end of said funnel-shaped wall portion and being connected thereto, said outer end wall being provided with a plurality of outlet openings; and a plurality of flexible strips situated within the funnel-shaped wall portion and connecting the central portion of the outer end wall to the small end of the funnel-shaped wall portion, said flexible strips serving to maintain the outer end wall in its expanded shape during use.

2. An attachment according to claim 1, in which the small end of the funnel-shaped wall portion engages the exterior surface of the air discharge nozzle, and said connecting means includes an elastic band holding the funnel-shaped wall portion small end in tight engagement with the air discharge nozzle exterior surface.

3. An attachment according to claim 1, in which said connecting means includes a tubular section for sliding engagement with the exterior surface of the air discharge nozzle, and an elastic band holding the funnel-shaped wall portion small end in tight engagement with the exterior surface of the tubular section.

4. An attachment according to claim 3, in which the central portion of the outer end wall is disc-shaped and non-flexible and constitutes an end closure for the tubular section when the attachment is in its collapsed position.

5. An attachment according to claim 1, 2, 3 or 4, in which the total area of the outlet openings in the outer end wall is greater than the cross-sectional area of the air discharge nozzle.

* * * * *